US006938451B2

(12) United States Patent
Elmaleh

(10) Patent No.: US 6,938,451 B2
(45) Date of Patent: Sep. 6, 2005

(54) DYNAMIC TAPERED EXTRUSION SYSTEM

(76) Inventor: Jon Elmaleh, 45 Strong Pl., Brooklyn, NY (US) 11231

( * ) Notice: Subject to any disclaimer, the term of this patent is extended or adjusted under 35 U.S.C. 154(b) by 108 days.

(21) Appl. No.: 10/219,428

(22) Filed: Aug. 15, 2002

(65) Prior Publication Data

US 2004/0031307 A1 Feb. 19, 2004

(51) Int. Cl.[7] ..... B21B 1/08
(52) U.S. Cl. ..... 72/240; 72/224
(58) Field of Search ..... 72/240, 7.1, 7.2, 72/14.8, 178, 247, 224, 225

(56) References Cited

U.S. PATENT DOCUMENTS

| | | | | | |
|---|---|---|---|---|---|
| 2,687,052 | A | * | 8/1954 | Zeitlin | 72/9.4 |
| 2,792,730 | A | * | 5/1957 | Giuseppe | 72/9.4 |
| 3,499,305 | A | * | 3/1970 | Abernathy | 72/7.1 |
| 4,283,930 | A | * | 8/1981 | Hasegawa et al. | 72/8.9 |
| 5,319,952 | A | * | 6/1994 | Cadney | 72/181 |
| 6,250,126 | B1 | * | 6/2001 | Yasuda et al. | 72/241.2 |
| 6,658,910 | B1 | * | 12/2003 | Gerth et al. | 72/224 |

FOREIGN PATENT DOCUMENTS

| | | | | |
|---|---|---|---|---|
| JP | 02121703 A | * | 5/1990 | B21B/1/38 |
| JP | 08057512 A | * | 3/1996 | B21B/37/24 |
| JP | 08187504 A | * | 7/1996 | B21B/37/24 |

* cited by examiner

*Primary Examiner*—Lowell A. Larson
(74) *Attorney, Agent, or Firm*—Notaro&Michalos PC

(57) ABSTRACT

A hard metal or non-metal member can be formed or shaped to have varying amounts of curvature and tapering by passing the member through a forming channel defined by two sets of opposed, axially displaceable rollers which can be dynamically moved horizontally and vertically in a predetermined range. The rollers are controlled by a computer, a translator, and a electro-mechanical displacement system such as a servo motor. Using data input by a user or preprogrammed instructions containing displacement instruction in the computer, the computer can subsequently instruct servo motors, via a translator, to move the rollers in the available axial directions. The servo motors may include a mechanism for converting rotational movement into fine linear mechanical movement of the rollers. The timing and rate of movement, direction, and force of the roller can be controlled to form and shape the member into a specific contour of curves or tapering sides.

3 Claims, 6 Drawing Sheets

DYNAMIC TAPERED EXTRUSION SYSTEM

FIELD AND BACKGROUND OF THE INVENTION

The present invention relates generally to the field of shaping and forming metals and hard non-metals, and in particular to a new and useful system and method for dynamically and continuously forming and shaping metals and nonmetals into various shapes and sizes.

Metals are typically formed or shaped by extrusion through dies or between rollers. However, the dies or rollers are typically arranged in a particular pattern to form or shape the metal in a repetitively consistent manner. These systems and methods are disadvantageous because they are constrained to a particular shape or a fixed degree of extrusion. A system and method is needed for dynamically and continuously shaping and forming metals and nonmetals into tapered or curved products.

U.S. Pat. No. 4,770,017 teaches a method and apparatus for forming plates into shapes having a double curved surface. A plate is passed between a series of rolls which are mounted at predetermined intervals. Entrance and exit rolls are fixed in arbitrary positions, but are vertically adjustable. Flexible rolls are supported in a flexible state and cause deformation based on vertical position. However, the apparatus lacks computerized dynamic control of roll movement.

The plate is formed to shape by undergoing a transverse deformation which is delimited by the shape of the flexible rolls. The plate is also subjected to longitudinal deformation depending on the vertical positions of the entrance and exit rolls relative to the intervening flexible rolls. The rolls include roll members which have a cylindrical circumferential surface. The plate is deformed to a shape which is defined by the roll members. The plate does not undergo deformation in locations where it is gripped by the roll members.

U.S. Pat. No. 4,407,056 discloses a method for making metal sections, including one process of shaping a blank prior to rolling in which pressure is exerted on both the vertical and horizontal surfaces of the blank. The shaped blank is rolled to produce the final product. Dies are used to exert pressure on the blank during the pre-forming process.

U.S. Pat. No. 4,424,652 discloses a pre-cambered steel beam which is formed in a two-step process. A steel sheet is first passed through a series of rollers to provide the desired beam shape. The beam has a consistent cross-sectional shape along its length. The shaped beam is then passed through a deflection guide to give it a curvature defined by the deflection angle of the guide. The rollers used to shape the sheet in to the beam shape are arranged in stages to shape a particular segment of the beam as it passes the rollers.

U.S. Pat. No. 4,074,557 discloses a metal extrusion process for making beams and shaped rods from metal blanks. Rollers are used to press the metal blank down to a particular shape as the blank is forced through an opening defined by the rollers. The rollers are held in a fixed position during the extrusion.

U.S. Pat. No. 5,890,388 teaches an apparatus comprising top and bottom rolls which shape a strip or bar of metal into a desired shape. The apparatus is used for forming an angle shaped structural member in which additional mass is needed in the center of the substrate for providing the required mass in the apex section of the formed finished product. The heating of the center section in combination with a guide roll and die assembly moves metal laterally to the center of the bar or strip. At least one pair of edge rolls on the sides of the strip or bar presses material mass towards the center. The top and bottom rolls shape the displaced material for forming an apex at the top surface.

U.S. Pat. No. 3,572,075 teaches a method for manufacturing circular metal parts from cylindrically shaped metal billets, using an array which comprises top and bottom sets of rollers. The rollers are individually rotatably mounted and are arranged so that the two sets can be moved relative to each other in a direction along an axis that lies between the rollers. The rollers are used to impose a force on a billet, causing the billet to expand radially outward between the rollers. The rollers are contoured so as to obtain a particular shape. The apex end of each roller may be round for example. The rollers may also have helical grooves to provide sufficient force to move the metal in a desired direction.

An apparatus and method for decreasing the width of a metal slab is disclosed by U.S. Pat. No. 4,651,550. Two opposed axially movable dies are positioned on each side of a slab, so that as the slab moves past the dies, the original width of the slab is decreased in accordance with the distance between the dies.

U.S. Pat. No. 4,848,127 teaches press tools for reducing the width of a slab as well. The press tools are arranged opposed to each other on each side of a slab. The tools may be moved toward or away from each other as the slab is moved through the space between the tools.

Furthermore, temperature is a significant factor in rolling applications relating to formation and shaping of metals. A system and method is needed that is not temperature dependent while still effective. U.S. Pat. Nos. 5,454,888, 5,496,425, and 5,704,998 teach methods of forming high strength steel structural members such as I-beams from a blank of steel material under various temperature conditions and rolling or die extrusion processes.

U.S. Pat. No. 5,454,888, for example, discloses a method for warm forming high strength steel structural members from a blank of steel material by rolling or extruding at warm temperatures. In one embodiment, an I-beam stock is heated to 800° F. and extruded through a tapered die to warm form a finished I-beam structural member. U.S. Pat. No. 5,496,425 discloses a method for cold forming high strength steel structural members by passing rollers over the length of a blank until it is formed into a desired shape. Gallagher U.S. Pat. No. 5,704,998 discloses a method for hot rolling a blank at a temperature of 2000° F.

U.S. Pat. No. 6,325,874 similarly teaches a method for cold forming flat-rolled banks into high-strength structural members. Flat-rolled blanks are derived from a coil of steel material, sheet, plate or generally planar stock material. Rollers are repeatedly passed over the length of the flat-rolled blanks without heat treatment, until the desired shape is formed.

U.S. Pat. No. 5,749,256 discloses a method of hot rolling a beam having a web with open spaces. The method is particularly useful for forming castellated I-beams and C-beams. The beam shape is formed during a hot-rolling process, to set the flanges and web thickness and shape.

Although a variety of apparatuses and methods for shaping and forming metals are well known in the art, there is still a need for computerized continuous dynamic shaping and forming of metals into various shapes and sizes. For example, some methods use rollers which are flexibly mounted to accommodate a tolerance, but which are not dynamically displaceable. Other methods use rollers which cannot be moved at all.

Using such devices unnecessarily restricts a manufacturer to a certain shape or size for a product. When the dimensions, shape, or size of a desired product need to be changed, the apparatus needs to be changed to accommodate formation of the new product, which is not cost efficient. Also, some methods rely on temperature as a factor. Accordingly, the present invention provides a more adaptable, dynamically changeable apparatus and method that can be used for forming and shaping a variety of different products, without the need for equipment replacement or particular temperature conditions.

SUMMARY OF THE INVENTION

It is an object of the present invention to provide a system and method for extruding metals and nonmetals into various shapes and sizes.

It is a further object of the present invention to provide a shaping system which can dynamically change to different positions on one or more axes for dynamically and continuously extruding metals into various shapes and sizes.

It is another object of the present invention to provide a system and method for extruding metals and nonmetals into various shapes and sizes without the requirement of a temperature variable such as that found in heat forming.

Accordingly, a system and method are provided for making metal and nonmetal products of various shapes and sizes. A system of the invention has a series of computer-controlled rollers, which have two axes of movement and are displaceable within predetermined ranges. The rollers are adaptable and flexible to permit dynamic and continuous changes to their movement when needed. As the metal or nonmetal passes through a forming channel between two rows of the movable rollers, the rollers move up or down and toward or away from each other. The relative position of the rollers shapes the metal or non-metal to form a taper, curve, or other shape in a product such as an I-beam for example. The resulting product can have a contour, dimension or shape that varies along the length of the structure.

A method of the invention includes the steps of designating a predetermined path of horizontal and vertical movement, or longitudinal and transverse movement, of rollers against a metal or non-metal, inputting the path into a computer for the production of an algorithm via x and y coordinates, converting the computerized algorithm into an electronic signal, sending the electronic signal to an electromechanical displacement system for moving the rollers, feeding a metal or hard non-metal through a forming channel between moving flexible rollers, and kneading the metal or hard non-metal with the moving rollers. The electromechanical displacement system for moving the rollers may include mechanisms for translating rotational speed or torque into fine mechanical movements.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
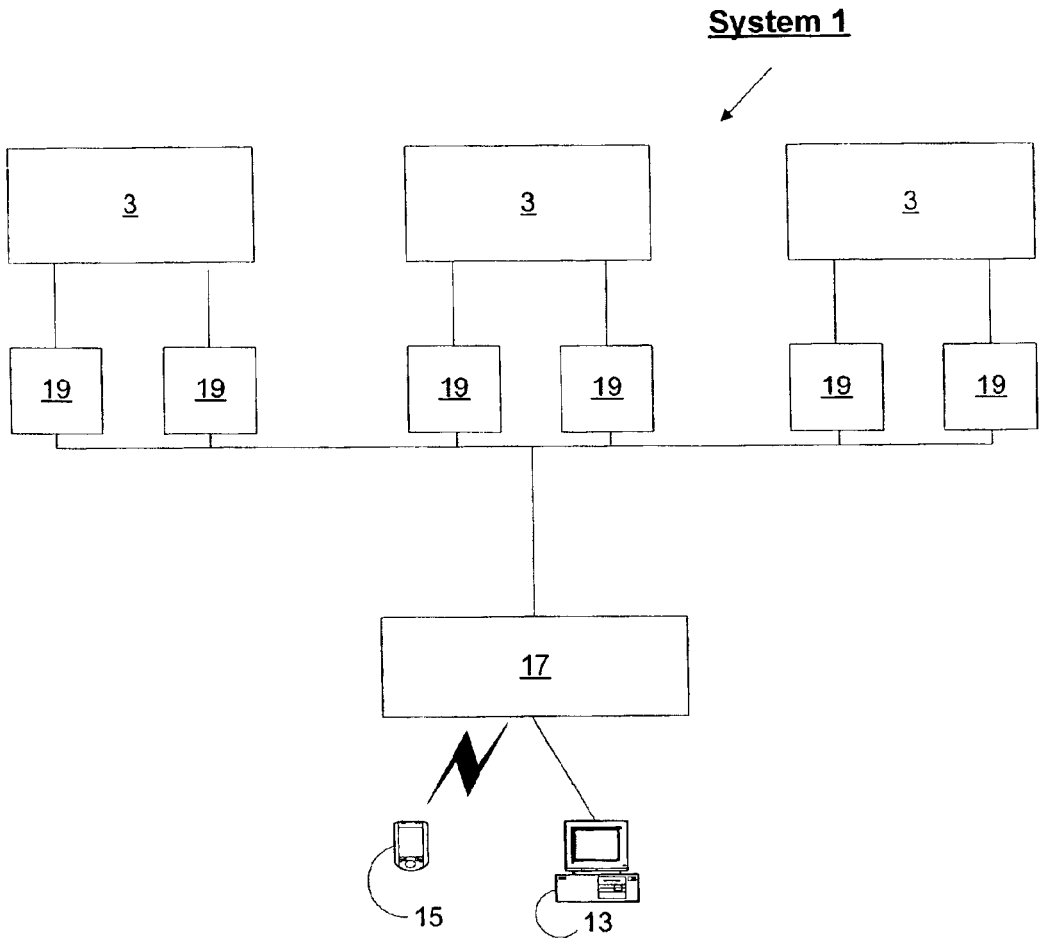
FIG. 1 is a diagram of the extrusion system.

Referring now to the drawings, in which like reference numerals are used to refer to the same or similar elements, FIG. 1 shows a dynamic tapered extrusion system 1 of the invention having a series of displaceable rollers 3 connected to a translator 17. The translator 17 is connected to each roller 3 by a pair of servo motors 19. A computer 13 or wireless PDA 15 is provided for generating instructions for the translator 17.

The servo motors 19 are connected in pairs to each roller 3. Each servo motor 19 in the pair is capable of displacing the connected roller 3 along an axis, so that each roller 3 can be moved along two axes. Preferably, the two axes of movement are perpendicular, such as along a horizontal axis and a vertical axis of the roller. The servo motors 19 can include an electro-mechanical or electro-hydraulical displacement system.

The movement of the rollers 3 is controlled by commands generated by a computer 13 and routed through translator 17 to the designated servo motors 19. The computer 13 is capable of simulating horizontal and vertical displacement in the form of algorithms. Other types of computing devices such as a thin client or PDA 15 may be used alternatively for generating algorithms and communicating with the rest of the system by wireless connection. The algorithms are converted into physical horizontal and vertical displacement of the rollers 3 by translator 17 interpreting the computer 13 output and generating and sending electrical control signals to servo motors 19.

Figure 3:
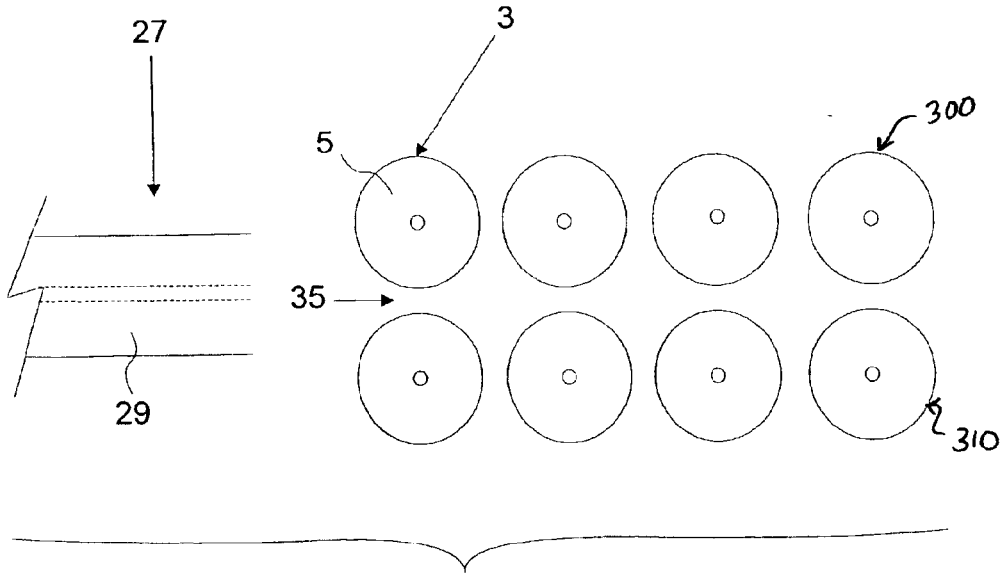
FIG. 3 is a top plan view of the rollers.
Figure 4:
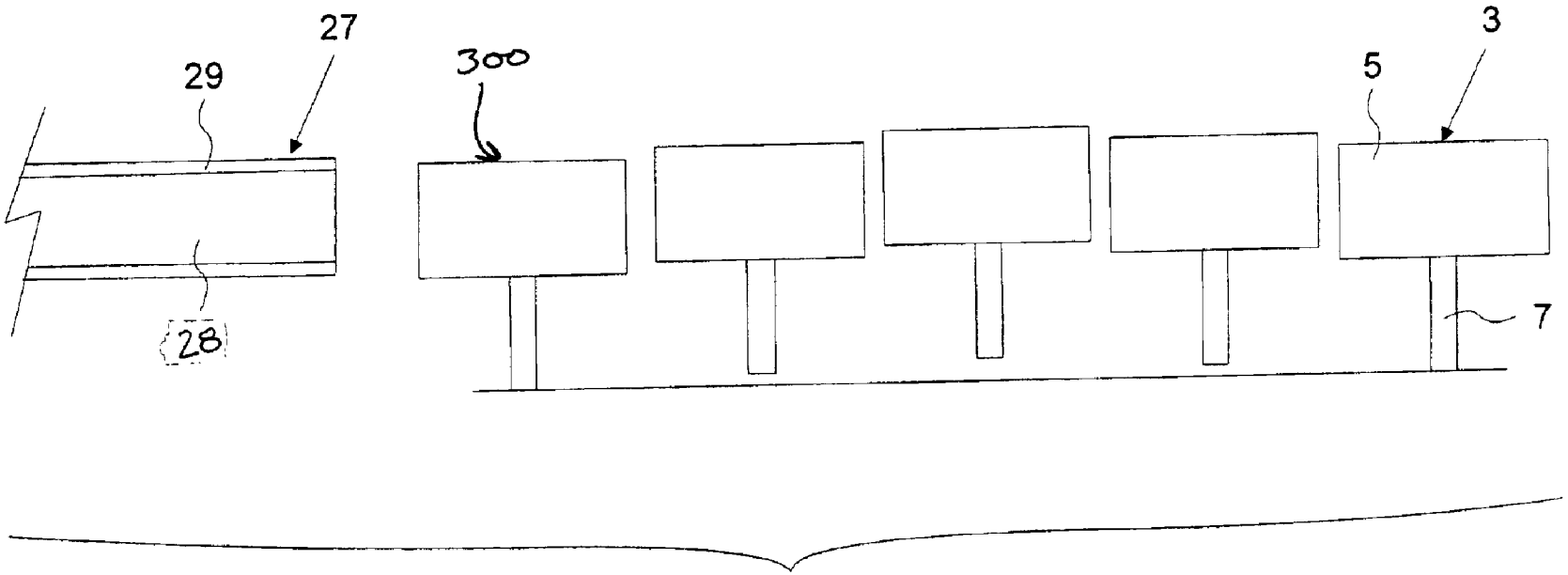
FIG. 4 is a side elevation view of the rollers.

As illustrated by FIGS. 3 and 4, the rollers 3 of the system 1 are preferably arranged in two opposed sets 300, 310 of rollers 3 to define a forming channel 35 between them. The system 1 may have with only one set 300 of rollers 3, so long as there is a solid surface such as a plate or die (not shown) on the opposing side of the forming channel 35. A roller 3, which is made of metal or steel, has a round head 5 and a leg 7. The leg 7 and round head 5 together are displaceable on two axes. They can move vertically or horizontally.

In a preferred embodiment of the invention, a microcontroller-based servo motor controller board is used as a translator 17. The servo motor controller board 17 comprises a microcontroller for processing data, a servo output port for controlling one or more servo motors, a power source, an interface to a computer, and an input port. The microcontroller of the servo motor control board 17 receives and processes signals from the computer 13 and outputs pulse width modulated signal to servo motors 19 attached to the rollers 3. As discussed above, two servo motors 19 are attached to each roller 3. Preferably, one servo motor 19 controls horizontal displacement of the roller 3, while the other servo motor 19 controls vertical displacement of the roller 3. The servo motor controller board 17 can select which servo motor 19 to control and the position of the servo motor 19. Programming a control system for execution by the translator 17 to precisely control the servo motors 19 will be easily understood by one familiar with electrical control systems.

The servo motor 19 generates a torque that displaces the connected roller 3. The operation of servo motor 19 affects the positioning of the connected roller 3.

Figure 2A:
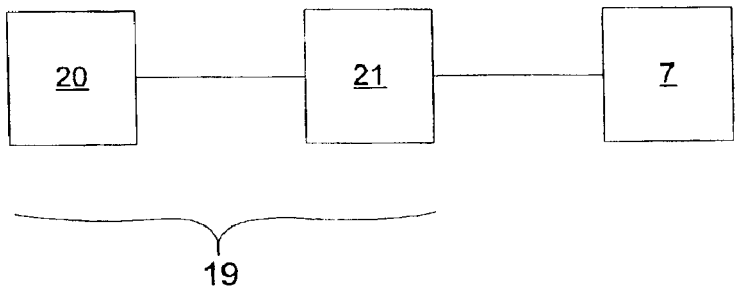
FIG. 2A is a representation of a servo motor and gearset connected to a roller leg.
Figure 2B:
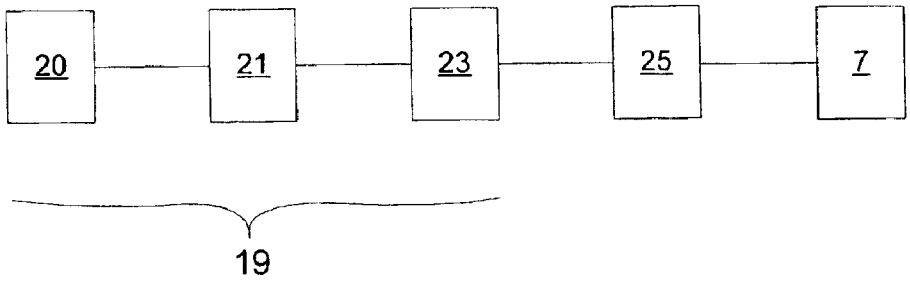
FIG. 2B is a representation of a servo motor, gearset and output shaft connected to a roller leg via a lever arm.

As shown in FIGS. 2A and 2B, the servo motor 19 typically contains an electric motor 20, a gearset 21, and a feedback potentiometer. The servo motor 19 further has an output shaft 23 at one end and a connector with power, control signal, and ground wires attached at the other end. The motor spins at variable speeds and is a coupled to the gearset 21, as shown in FIG. 2A, which can translate a high motor rotation speed to a fine mechanical movement. The gearset 21 is connected to actuate the leg 7 of roller 3.

Alternatively, a mechanical linkage, prefabricated disk, or lever 25, can also be attached to the output shaft 23, as shown in FIG. 2B. A lever arm 25, connected to the leg 7 of the roller 3, can be rotated for example, to vertically displace the roller 3. A mechanical linkage connected to the servo motor can also be used to displace the roller 3 horizontally.

Referring again to FIGS. 3 and 4, an I-beam 27, having a bar 28 and flanges 29, is passed through forming channel 35 defined by the two sets 300, 310 of rollers 3 to shape the I-beam 27. The shape of the channel 35, and thereby the I-beam 27, can be changed by moving rollers 3 toward each other horizontally. The rollers may also move up and down as demonstrated FIG. 4 to further change the shape of the channel, such as to stretch the height of the I-beam 27.

As the head 5 of each roller 3 makes contact with the I-beam 27, they knead the I-beam 27, causing shape changes, such as tapering and curving for example. The rollers may engage the I-beam 27 from both sides, moving closer to each other, or they may move away from each other at a particular rate of time, while still applying a force to the I-beam 27.

The difference in the distance between two opposing rollers 3 may also define the shape of the I-beam 27. The shape and configuration of the rollers can affect the shaping of the I-beam 27. The rollers are preferably round, but may have grooves and projections and can be different sizes. The timing of the movement of the rollers, which is controlled by the algorithms generated by the computer 13, can also affect the shaping process. One roller is actuated against a steel member to begin a taper, and the timing of the subsequent rollers 3 in engaging the material may be critical for producing a final product with a constant rate or degree of curvature. There may also be a need to suddenly disengage a roller 3 to sharply end a taper or curve.

FIGS. 5A, 5B, 5C, and 5D show a progression of the forming and shaping of a solid metal beam 31 with one set 300 of rollers 3 remaining stationary.

Figure 5A:
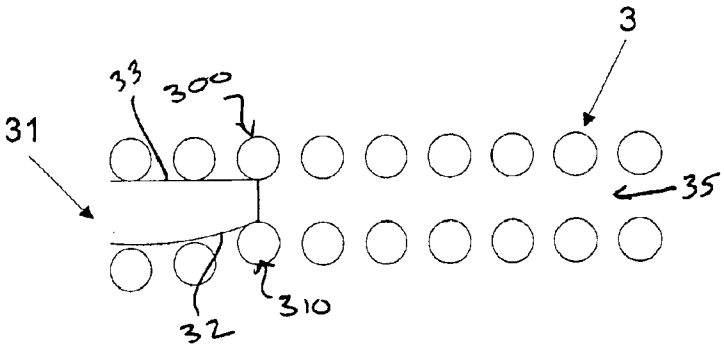
FIG. 5A is a graphical representation of a first position of rollers forming a taper in a metal member at one end as it progresses between the rollers.

In FIG. 5A, metal beam 31 is moved longitudinally through the forming channel 35 between the sets 300, 310 of rollers 3. The channel 35 is initially sized the same width as the desired minimum height for the tapered end 32 of the beam 31. As the metal beam 31 moves through the channel 35, one set 310 of rollers 3 begins to be displaced horizontally away from the second, opposed set 300 of rollers 3 which remain unmoved. The rollers 3 knead the metal beam 31 at a rate and force determined by instructions from computer 13. The compressive force of the opposing sets 300, 310 of rollers 3 on the metal beam 31 shapes the beam 31.

Figure 5B:
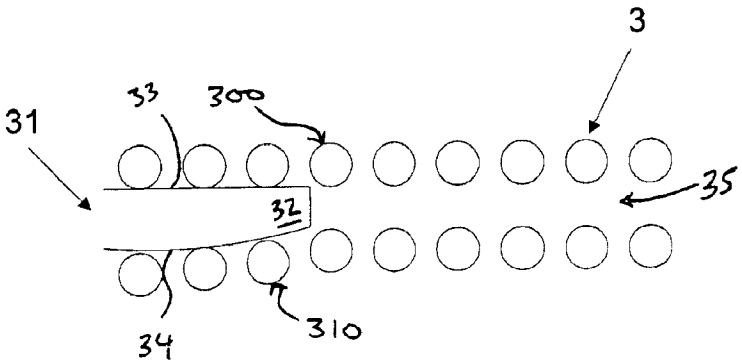
FIG. 5B is a graphical representation of a subsequent step in the progression of the metal through the rollers of FIG. 5A.

As more of the metal beam 31 proceeds through the channel 35 in FIG. 5B, more of the rollers 3 of one set 310 are displaced away from those of the other set 300. The rollers 3 closer to the end of the channel 35 displace farther, while those near the tapered end 32 remain closer together to preserve the tapered size of the beam 31. As a result of the rollers 3 displacing apart, and compressing the latter portions of the beam less 31, the metal beam 31 becomes curved or tapered as it passes through the forming channel 35.

The proximate side 34 of the metal beam 31 is shaped due to the timing and rate of movement, direction, and force of the displaced set 310 of rollers 3. The distal side 33 of the metal beam 31 remains straight because the distal rollers 3 do not move.

Figure 5C:
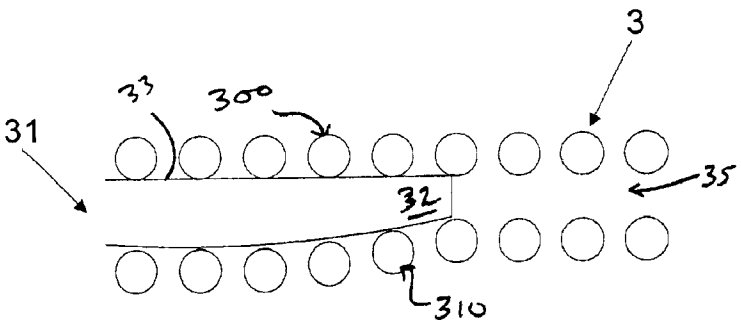
FIG. 5C is a graphical representation showing the progression of the metal between the rollers following the position of FIG. 5B.
Figure 5D:
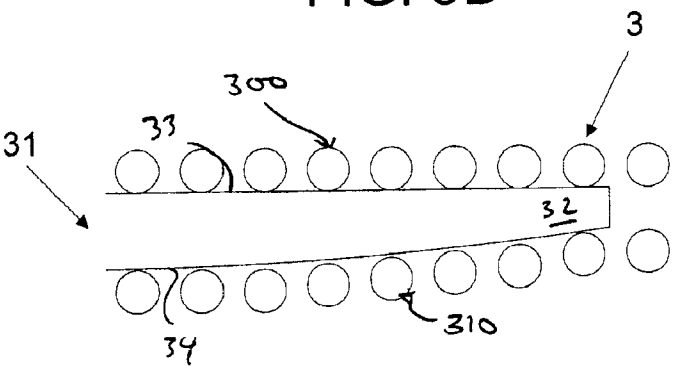
FIG. 5D is a graphical representation showing the progression of the metal between the rollers following the position of FIG. 5C.

As seen in FIGS. 5C and 5D, progressively more of the metal beam 31 has passed through the channel 35 and the tapered end 32 is distinct from the middle of the beam 31. The rollers 3 are displaced along the transverse axis as needed to shape the beam 31 as desired. The control system of FIG. 1 is used to direct the movement of the rollers 3 in both sets 300, 310 to provide the desired shape to the beam 31.

In an alternate embodiment of the invention, the static set 300 of rollers 3 may instead be a solid plate or die that a metal member being shaped slides across while the opposite side of the member is kneaded by only one set 310 of rollers 3.

Further the invention is well suited for shaping elongated pieces of metals and non-metals alike. Carbon fiber, fiberglass or plastic can all be shaped with the extrusion system 1 of the invention. The computer 13 and translator 17 of the system 1 can be adjusted to modify the range of movement of the rollers, since some non-ferrous metals or non-metals are not as hard as others, and require less force from the rollers for shaping and forming.

Figure 6:
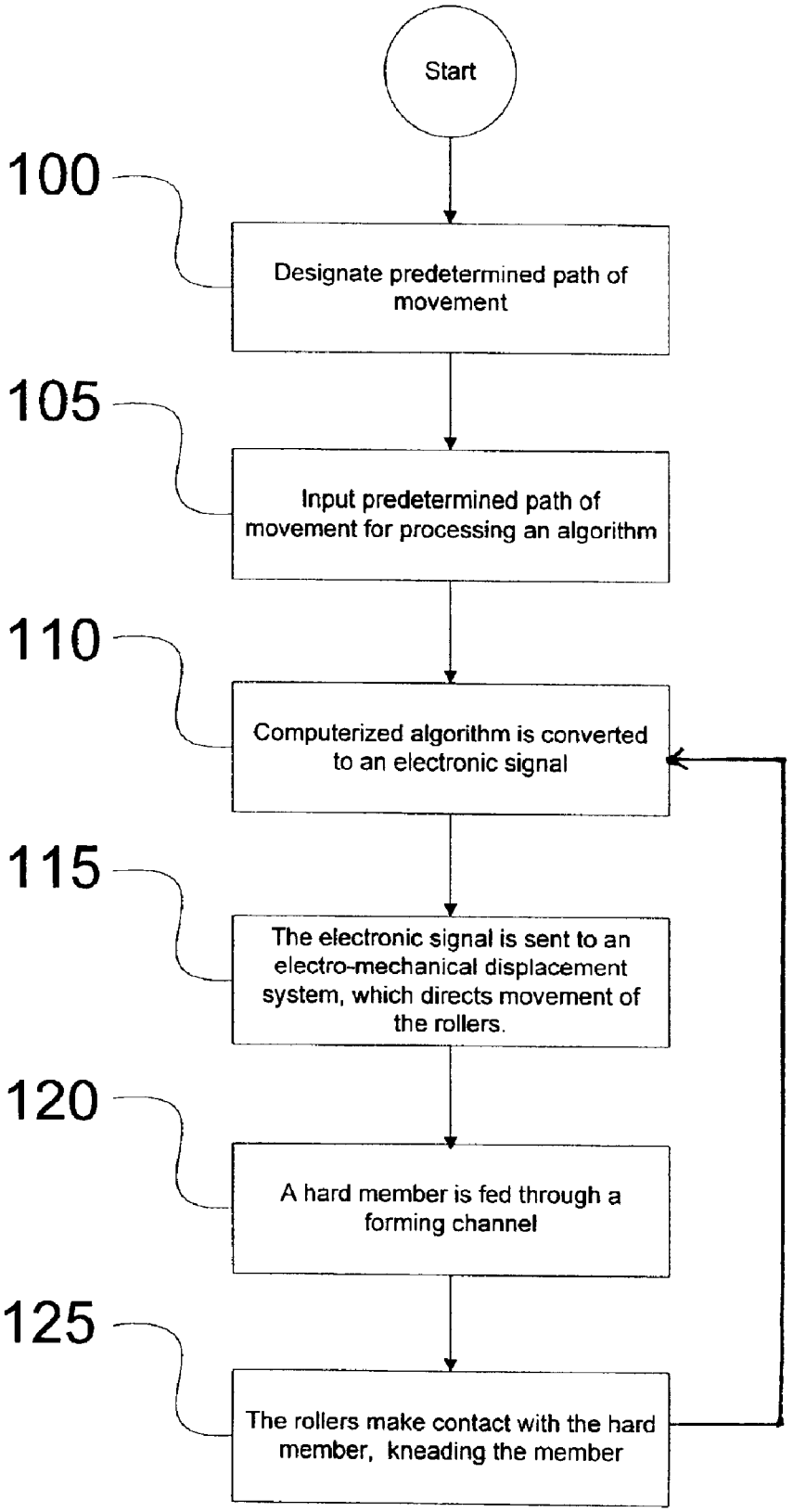
FIG. 6 is a block diagram of the steps for forming and shaping a metal or nonmetal using the system of the invention.

As shown in FIG. 6, the method of the invention begins with step 100, which includes designating a predetermined path of horizontal and vertical movement for the rollers 3 defining a forming channel 35 which will contact against a metal or hard non-metal member being shaped. Then, step 105 involves inputting the path into a computer for the production of a control algorithm via x and y coordinates. In step 110, the computerized algorithm is translated into an electronic control signal.

In Step 115, the electronic control signal is transmitted to an electromechanical displacement system, which causes movement of the rollers 3. The rollers 3 are preferably displaceable along two perpendicular axes, but they may be movable along any two axes selected for a particular purpose.

Preferably, the electro-mechanical displacement system for moving the rollers 3 comprises translating rotational speed or torque into fine mechanical movement via a servo motor 19.

In step 120, a metal or hard non-metal is fed through a forming channel 35 between axially movable rollers 3. In step 125, the rollers 3 make contact with the metal or nonmetal member fed through the forming channel 35. The rollers 3 knead the metal or hard non-metal upon contact. Steps 110 to 125 are repeated until the entire member is shaped as desired.

By varying the timing and rate of movement, direction, and force of the rollers 3, the shape of the metal or non-metal can be changed, as shown in FIGS. 5A–5D. In FIGS. 5A–5D, rollers 3 are positioned against the metal or non-metal at varying distances, and are only moved to make contact at a certain time when a certain part of the metal or non-metal is passing through the forming channel 35.

While a specific embodiment of the invention has been shown and described in detail to illustrate the application of the principles of the invention, it will be understood that the invention may be embodied otherwise without departing from such principles.

What is claimed is:

1. An apparatus for continuously forming and shaping an elongated member by dynamically kneading the hard material from opposite sides without the need for predetermined or fixed die arrangements or settings, comprising:

a forming channel having a variable gap width for passage of an elongated member in a travel direction in the channel, the channel being defined by a first row of rollers that are mounted for rotation about a rotation axis, and an opposed surface, each roller in the first row being displaceable along two axes which are transverse to each other and transverse to the travel direction, a first one of the two axes being transverse to, and a second one of the two axes being parallel to the rotation axis of a respective roller, displacement of the rollers along the first axis changing the gap width of the channel for varying a thickness of the elongated member in a direction parallel to the first axis and displacement of the rollers along the second axis varying a shape of the elongated member in a direction parallel to the second axis;

control means for generating electronic control signals from an input algorithm defining a shape for directing movement of the rollers to create the shape in the elongated member fed through the forming channel which includes variations in the thickness of the elongated member parallel to the first axis and variations in the shape of the elongated member parallel to the second axis;

a pair of servo motors connected to each of said rollers for displacing the connected roller along the two axes in response to electronic control signals received from the control means;

the rollers being made of metal and the opposed surface comprising a second row of rollers;

at least the first row of rollers being displaceable transversely across the forming channel toward and away from the second row of rollers; and the control means comprising a computer for inputting instructions and generating an algorithm defining the shape to output computer control signals, and a translator for generating the electrical control signals from the computer control signals.

2. An apparatus according to claim 1, wherein the computer is a thin client or wireless PDA.

3. An apparatus according to claim 1, wherein one axis is a vertical axis of the corresponding roller, each rotation axis being vertical.

* * * * *